US006276266B1

(12) United States Patent
Dietz et al.

(10) Patent No.: US 6,276,266 B1
(45) Date of Patent: Aug. 21, 2001

(54) MULTICOLOR PAD PRINTING SYSTEM

(75) Inventors: Volker Dietz, Batavia; Heinz Grob, West Chicago, both of IL (US); Kai-Uwe Fastje, Malterdingen (DE)

(73) Assignee: Illinois Tool Works, Inc., Glenview, IL (US)

( * ) Notice: Subject to any disclaimer, the term of this patent is extended or adjusted under 35 U.S.C. 154(b) by 0 days.

(21) Appl. No.: 09/315,910

(22) Filed: May 20, 1999

(51) Int. Cl.[7] ..... B41F 17/30

(52) U.S. Cl. ..... 101/41; 101/44; 101/DIG. 40; 347/103

(58) Field of Search ..... 101/35, 41, 42, 101/43, 44, 163, 492, 493, DIG. 40; 347/103

(56) References Cited

U.S. PATENT DOCUMENTS 3,990,364 * 11/1976 Paans ..... 101/43
4,723,485 * 2/1988 Berberich et al. ..... 101/44
5,054,390 * 10/1991 Birtles et al. ..... 101/41

* cited by examiner

*Primary Examiner*—John S. Hilten
*Assistant Examiner*—Leslie J. Grohusky
(74) *Attorney, Agent, or Firm*—Leydig, Voit & Mayer, Ltd.

(57) ABSTRACT

A pad printing system for applying high quality multicolor images to curved objects is provided. The pad printing system includes a substantially flat release substrate having an ink receiving surface and a digital printer having a plurality of print heads. The print heads of the digital printer are arranged to discharge ink in a plurality of colors onto the ink receiving surface of the release media substrate. The print heads and release substrate are movable relative to each other such that the discharge of ink from the print heads prints a multicolor ink image on the ink receiving surface of the release substrate. The pad printing system further includes a deformable ink transfer pad which is movable into pressure contact with the release substrate for receiving a multicolor ink image therefrom and movable into pressure contact with a curved object to be printed for transferring a multicolor ink image from the transfer pad to the curved object.

33 Claims, 5 Drawing Sheets

MULTICOLOR PAD PRINTING SYSTEM

FIELD OF THE INVENTION

The present invention relates generally to pad printing, and more particularly, to an improved multicolor pad printing system.

BACKGROUND OF THE INVENTION

Pad printing is a common method for printing images on curved or other non-flat surfaces such as spherical, conical, cylindrical and other curved objects. Pad printing systems utilize a deformable pad which receives images from a flat cliche plate and transfers the images to the curved surface which is to be printed. Typically, an inverted cup containing a quantity of printing ink is used to apply the ink to the cliché plate. To apply a new coating of ink to the cliché plate, the ink cup and cliche plate are moved relative to each other following each ink transfer operation.

While pad printing is a very efficient method for printing single color images on spherical or other curved items, there is an increasing demand, particularly in the golf ball industry, for printing customized, multiple color images on curved objects. However, there are several significant problems with using conventional pad printing techniques to print multiple color images on an object.

Since conventional color separation printing utilizes four basic colors, namely blue, yellow, red and black, conventional multicolor pad printing systems are equipped with four separate color stations which enable the system to achieve any final desired color. Each color station includes an ink dispensing cup containing the colored ink and a respective cliché plate. As will be appreciated, such multicolor pad printing systems are not readily or cost effectively adaptable to print custom images because each of the four separate color stations must be reconfigured in order to run a new image. Moreover, to print a multicolored image, the printing pad must be successively cycled between the cliché plate of each color station and the object on which the image is to be printed, with each color image being deposited over the previously deposited image. Thus, unlike printing a single color image, which in most cases does not require precise positioning of the image on the object, printing multicolor images requires the individual images be printed in a precise location on the object.

With conventional pad printing systems, however, it is inherently difficult to print the individual single color images which comprise the multicolor image in precise overlapping relation, even utilizing expensive, precision controlled mechanisms for guiding and moving the printing pad and the object to be printed. Since the individual images are not printed in exact registry, the resultant multicolor image is blurred. Accordingly, it has been difficult to achieve high quality multicolor images with pad printing. Additionally, cycling the printing pad through the various color stations is a time consuming process which significantly reduces the potential production output of the pad printing system further increasing the cost of pad printing multicolor images.

It often can take several weeks to set-up a conventional multicolor pad printing system to run a particular image. In particular, some of the steps which have to be performed include color separation, producing the film for each color, dip coating the plates, exposing the coated plates, edging the plates and setting up the inks. As will be appreciated, because of the time and cost associated with setting up a pad printer to run a different image, it is not practical to use conventional multicolor pad printing systems to produce relatively small numbers of custom printed parts. Moreover, since the multiple ink dispensing cups must be cleaned and then refilled after each print run, often resulting in ink spills, these multicolor pad printing systems also waste a significant amount of printing ink.

OBJECTS AND SUMMARY OF THE INVENTION

Accordingly, in view of the foregoing, a general object of the present invention is to provide a multicolor pad printing system adapted for high quality printing of multicolored images on spherical and other curved surfaces.

Another object is to provide a pad printing system as characterized above which can be operated more quickly and efficiently than existing multicolor pad printing systems.

A further object is to provide a multicolor pad printing system of the above kind which does not require expensive precision mechanisms for guiding and effecting movement of the printing pad and the object to be printed.

Yet another object is to provide a multicolor pad printing system of the foregoing type that is relatively simple in construction and lends itself to more economical manufacture and operation.

A related object is to provide such a multicolor pad printing system that more efficiently uses printing inks.

These and other features and advantages of the invention will be more readily apparent upon reading the following description of a preferred exemplary embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
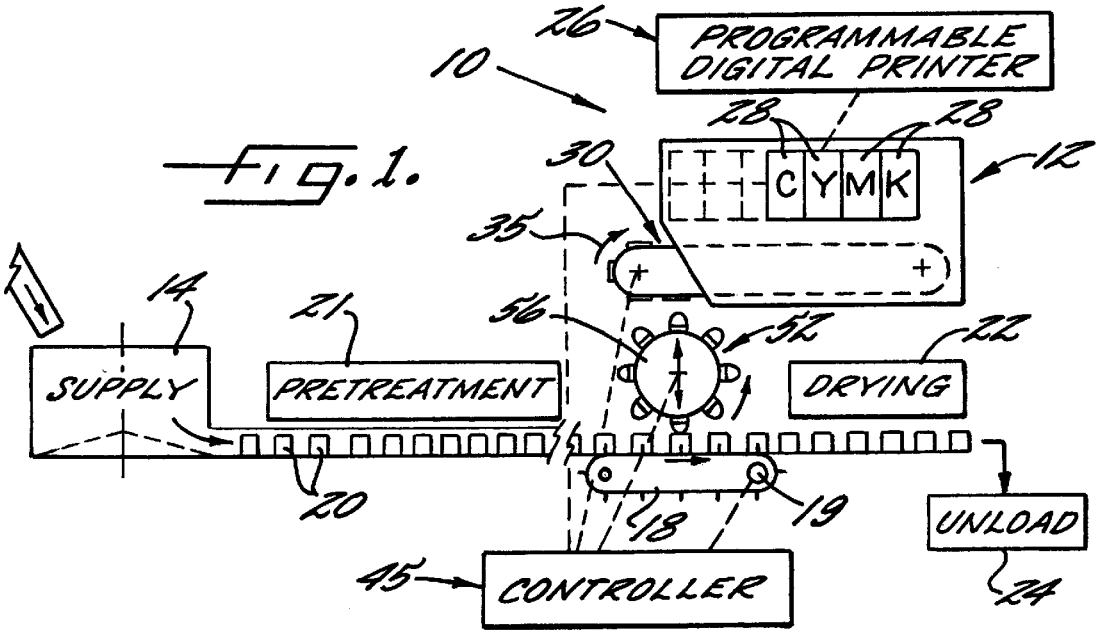
FIG. 1 is a schematic diagram of an illustrative printing line utilizing a multicolor pad printing system in accordance with the teachings of the present invention.

Referring now more particularly to FIG. 1, there is shown an illustrative printing line 10 which includes a multicolor digital pad printing system 12 embodying the teachings of the present invention. The illustrated printing line 10 is particularly adapted for printing images on non-flat surfaces such as those presented by spherical (e.g., golf balls), conical cylindrical and other curved objects or parts 16. While the present invention is described in connection with printing images on curved surfaces, it will be readily appreciated that the present invention is equally applicable to printing on any type of surface including, for example, flat surfaces.

The parts are fed to the printing line 10, in this case, by a supply or loading station 14 which is arranged at the beginning of the printing line 10 and is operable to feed the objects 16 to be printed to a part handling system. In the illustrated embodiment, the part handling system comprises a part conveyor 18 which is driven by a drive motor 19 and includes a plurality of fixtures 20 which are adapted to hold the individual parts 16 as they are carried through the printing line 10. In order to ensure that the parts 16 are held in the proper orientation for the printing operation, the supply station 14 and part handling system can include an electronic vision system that reads the orientation of the parts 16 and makes adjustments to their position as necessary.

Prior to performing the actual printing operation, the parts 16 are conveyed through one or more pretreatment stations 21 as shown in FIG. 1. The pretreatment stations 21 can be used to prepare the parts 16 for the printing operation. In the illustrated embodiment, the parts 16 are then conveyed through the pad printing system 12 wherein an image is applied to the parts as described in detail below. After the image is applied, the parts 16 are then conveyed through one or more dryers 22 which dry or cure the printing inks on the parts. Finally, the parts 16 are unloaded from the part conveyor 18 via an unloading station 24 which can be arranged to feed the parts directly to a packaging system.

In accordance with an important aspect of the present invention, the pad printing system 12 in the illustrated printing line 10 incorporates a digital color printer 26 that enables the pad printing system to apply high quality multicolor images onto non-flat surfaces such as spherical and other curved objects. The use of the digital color printer 26 eliminates the need to use four separate color stations as are found in prior multicolor pad printing systems and through which a printing pad must be successively cycled to create a multicolor image. Likewise, there is no need for the associated precision controlled mechanisms for moving and guiding the printing pad and the object to be printed which must be used in existing systems to try to print the individual one color images in registry on the object. Accordingly, the pad printing system 12 of the present invention can print high quality multicolor images much more quickly and efficiently than existing multicolor pad printing systems.

Figure 2:
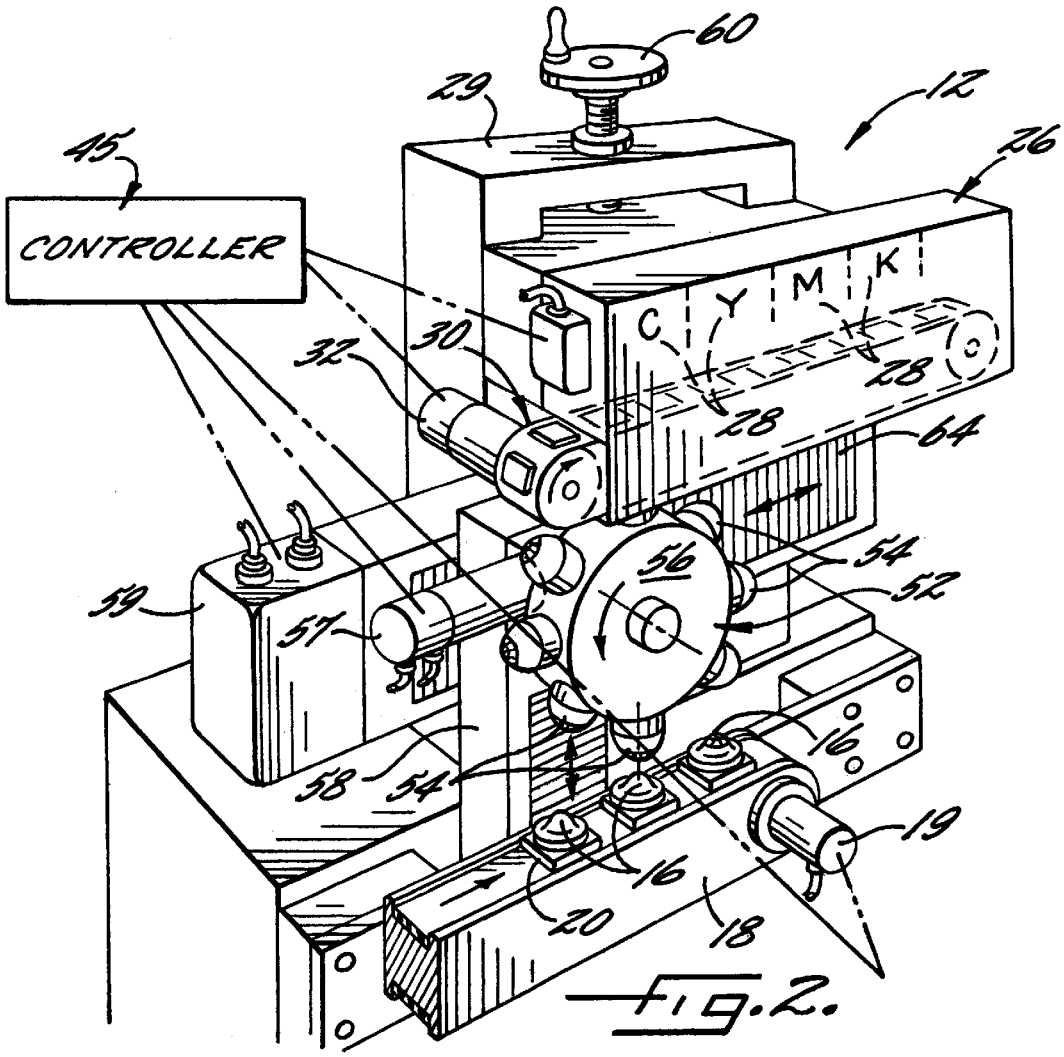
FIG. 2 is a perspective view of one illustrative embodiment of the pad printing system of the present invention which picks up and transfers image through a stamping action.
Figure 3:
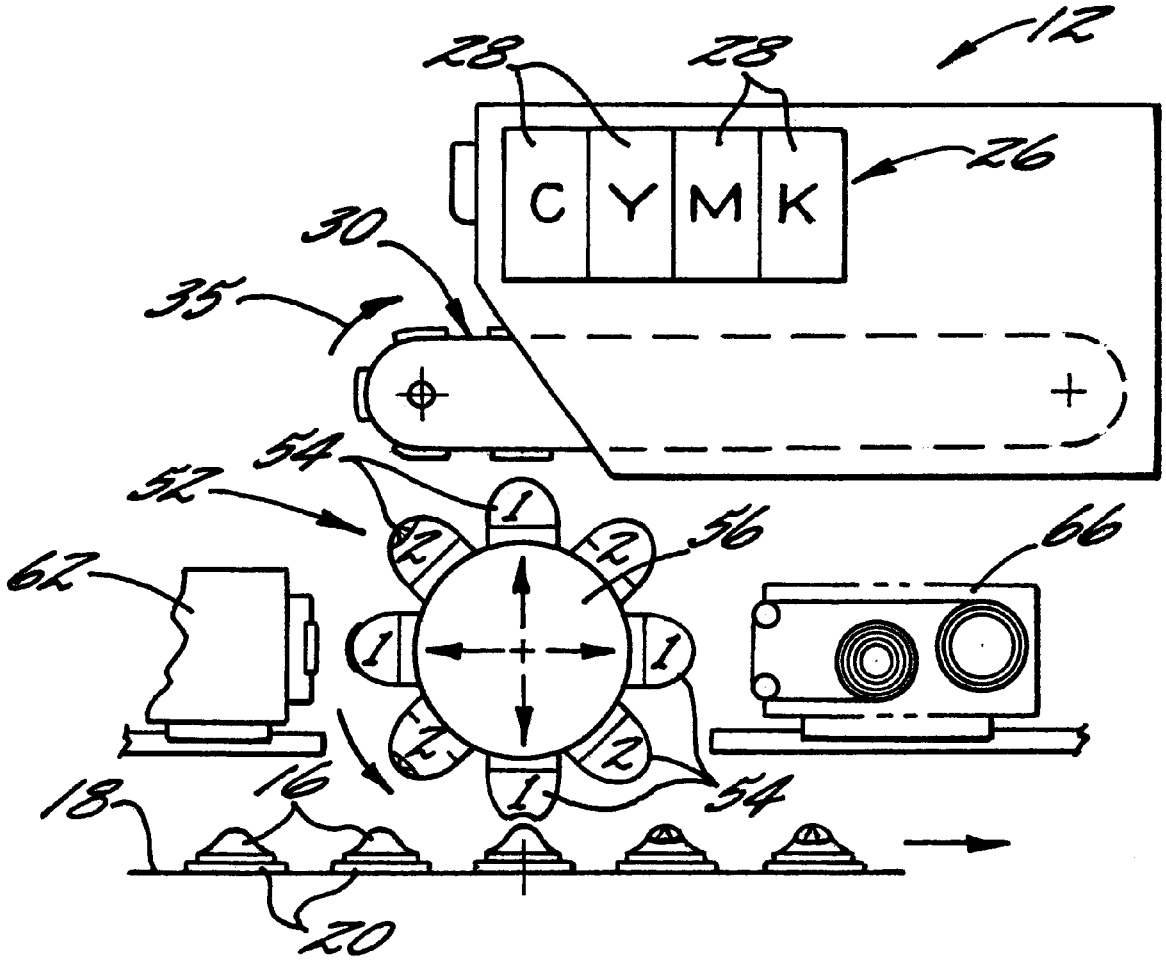
FIG. 3 is a partial side elevation view of the pad printing system of FIG. 2.

In carrying out the invention, in the illustrated embodiment, the digital printer 26 includes one or more print heads 28 for discharging each of the four basic colors used in color separation printing, blue (C), yellow (Y), red (M) and black (K), as shown in FIGS. 1–3. Each print head 28 discharges a programmed array of dots in one of the four basic process ink colors with the array of dots produced by the four or more print heads being arranged in precise overlapping relation to each other so as to achieve the desired colors and image. In addition to the four basic process ink colors, it will be appreciated that the individual print heads could also be adapted to discharge ink of any color. In this case, the digital printer 26 and associated print heads 28 are supported on a stand 29 which also supports the other major components of the pad printing system 12. In one preferred embodiment, the digital printer 26 comprises a commercially available piezoelectric ink jet printer sold by MIT/Nu-Kote under the tradename PiezoJet™ and model designation XL 128–360. With this printer, each print head has one hundred twenty-eight ink jets which discharge ink via vibratory movement of a piezoelectric element. Alternatively, as will be understood by one skilled in the art, other types of digital printers could be used including, for example, the continuous flow type digital printers offered by NUR Macroprinters, laser printers or bubble-type printers.

Since such digital printers can be easily programmed to produce different images, the pad printing system 12 of the present invention can be quickly and easily set-up to produce any type of custom multicolor image. Thus, the pad printing system 12 is much more flexible than prior designs in that it can be used to run even a relatively small number of custom printed parts in a cost effective manner. Moreover, the use of the digital color printer 26 eliminates the need to clean and refill multiple ink cups after each print run, thereby enabling the printing inks to be used much more efficiently.

Figure 5:
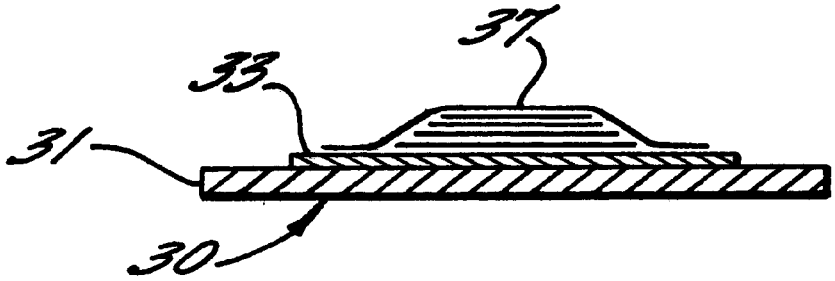
FIG. 5 is a side sectional view of the release media for the pad printing system.

Because the print heads of a digital printer must be arranged a fixed distance from the surface on which they are discharging ink in order to produce a high quality image, a digital printer, in most cases, cannot be used to print directly onto a curved object. Accordingly, with the present invention, the print heads 28 of the digital printer 26 are arranged to discharge onto a flat surface or substrate comprising a release media 30. The release media 30 is made of a material which will receive a high quality image from the digital printer and enable that image to be subsequently transferred via a deformable pad to a curved object. As shown in FIG. 5, the release media 30 preferably comprises a plate or belt 31 which is coated with a layer 33 of a material such as silicone or rubber which will allow for easy transfer of the layers of ink 37 produced by the print heads which form the image. Other types of coatings that can be used as the release media include plastic, metallic, ceramic and plasma deposit coats. Additionally, the release media could comprise a relatively inexpensive coated paper. Of course, those skilled in the art will appreciate that any material which is capable of receiving and allowing for transfer of a multicolor ink image could be used as the release media.

In order for the print heads 28 to be able to print an image on the release media substrate 30, the print heads and the release media are supported on the stand 29 for relative movement with respect to each other. As will be appreciated by those skilled in the art, the relative movement necessary for producing the print image can be accomplished either by configuring the print heads 28 so that they are movable relative to a stationary release media, configuring the release media 30 to move relative to stationary print heads or by configuring the release media 30 and the print heads 28 so that they are both movable. In the illustrated embodiment, to enable continuous operation of the digital printer 26 and thereby optimize the production capacity of the pad printing system 12, the release media substrate 30 is configured as an endless belt conveyor which is driven by a suitable drive motor 32.

As shown in FIGS. 2–3, the release media conveyor, in this instance, is arranged on the stand 29 below and parallel to the discharge faces of the respective print heads 28 such that the release media 30 can continuously cycle in a conveying direction 35 underneath the print heads. As the release media 30 cycles underneath the print heads 28, the print heads discharge their respective colored inks onto the release media so as to produce a multicolor image. As is described in greater detail below, the release media conveyor 30 then carries the image to a transfer point where the image is picked up by a deformable pad for subsequent transfer to a part. As will be appreciated, the use of the endless release media conveyor 30 enables the printing and transferring operations to take place in parallel. Thus, the pad printing system 12 can operate with a much higher output than if the release media comprised a plate or the like which successively cycled between print and transfer stations in a similar fashion to the cliche plate of a conventional pad printer. It will be appreciated, however, that the release media can have any number of other configurations including such a cliche plate-like configuration.

Figure 4:
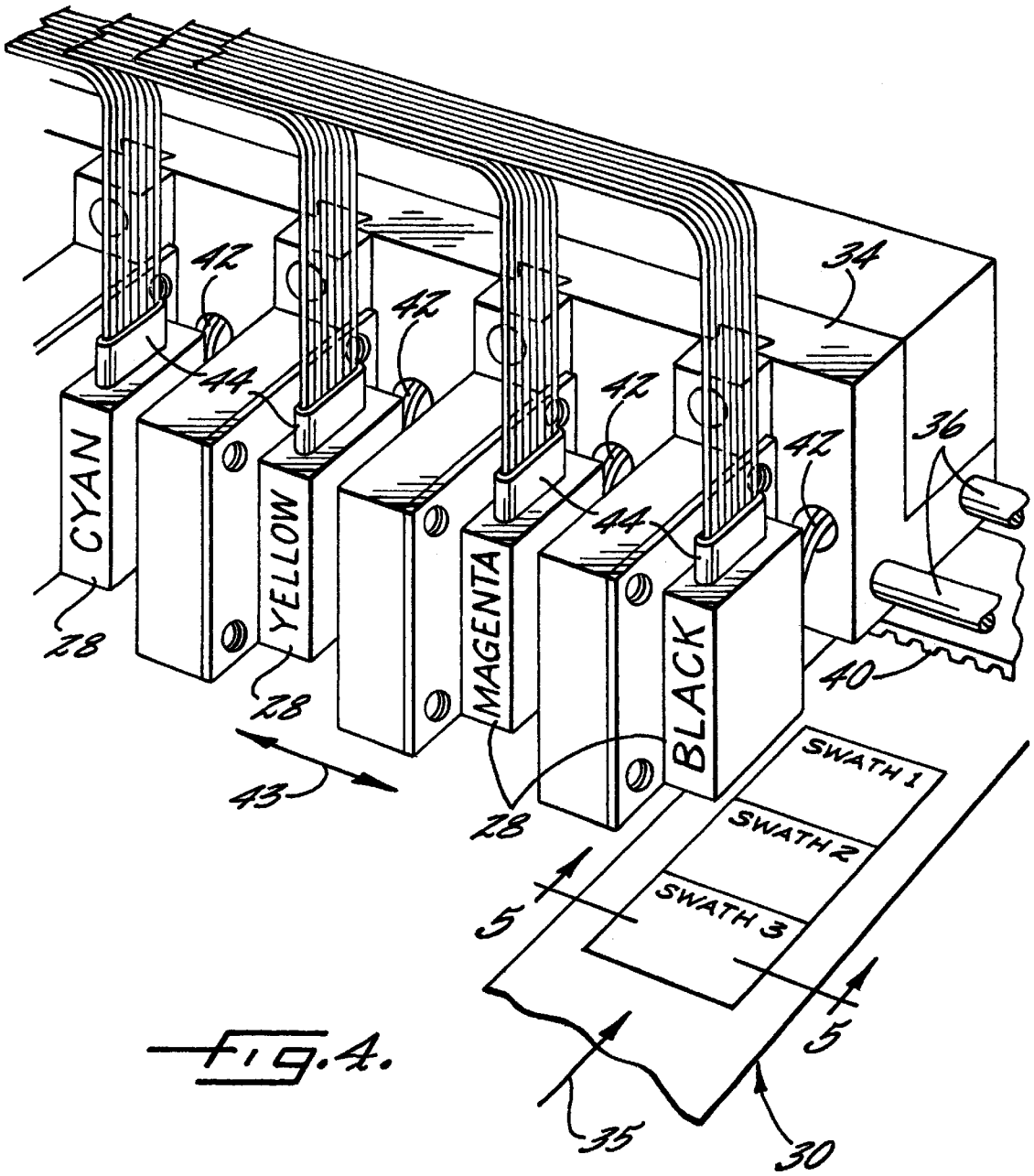
FIG. 4 is an enlarged perspective view of the print head carrier for the pad printing system of FIG. 2.

In accordance with a further aspect of the present invention, to enable the digital printer 26 to print images of sufficient size and resolution, the digital printer is configured to print images having a multiple swath width. As will be understood by one skilled in the art, the "swath" of a print head is the width across which the head can discharge ink at a certain resolution during a single pass, e.g., 0.36 inches at 360 dpi (dots per inch) for the PiezoJet™ printer described above. One method for printing images having a multiple swath width is to support the print heads 28 such that they can make multiple passes over the release media 30. For example, as shown in FIG. 4, the four color print heads 28 can be supported on a carrier 34 which is movable along a pair of guide rails 36 in a perpendicular or lateral direction relative to the conveying direction 35 of the release media 30. A suitable servo motor or the like is provided to drive reciprocal movement of the carrier 34 relative to the release media 30 along the guide rails 36, in this instance, via a toothed belt 40. In the illustrated embodiment, each print head 28 has an associated ink hose 42 for supplying ink to the head. Additionally, each print head 28 is connected to the control system of the printer 26 via a respective wire ribbon 44 so that the printer control system can regulate the amount and pattern of ink discharge from each print head.

To effectuate printing of an image, as shown in FIG. 4, the print heads 28 are arranged on the carrier 34 in aligned relation so that as the carrier moves laterally across the release media 30, as depicted by arrow 43, the print heads 28 each discharge a controlled amount of their respective colored ink in precise overlapping relation to produce one swath of the desired colored image. After each swath is printed, if the image is not yet complete, the release media 30 is advanced a distance equal to one swath width. Alternatively, if the image is complete, the release media 30 is advanced a preselected distance sufficient to separate the completed image from the next image to be printed. Once the release media 30 has been advanced the appropriate distance, the print head carrier 34 can then execute another pass across the release media. As will be appreciated, the number of passes required to produce a particular image will depend on the size and desired resolution of the image as well as the swath width of the print heads.

In order to ensure that the movement of the print head carrier and release media is properly synchronized, the drives for the print head carrier and the release media conveyor are connected to a common control system 45 as shown, for example, in FIG. 1. Likewise, in a known manner, the drive for the print head carrier also communicates with the control system of the digital printer 26. This allows the digital printer 26 to control, based on the desired image input into the printer, the movement of the print head carrier 34 including the number of passes of the carrier, the length of each pass as well as the rate at which the carrier travels. It will be appreciated that, in addition to heads which discharge printing ink, other types of heads may be provided, such as, for example, a head for discharging a final protective layer over the layers of colored ink which comprise completed image or a head for discharging an initial adhesive layer.

Alternatively, in order to further increase the potential production capacity of the pad printing system 12, sets of print heads 28 can be provided for each of the four basic colors. Such sets of multiple print heads 28 discharge ink across multiple swaths during a single pass. By using multiple print heads 28 to print each color, the need to have relative movement between the print heads 28 and the release media 30 along two axes, such as by reciprocating movement of the print heads, can be eliminated. In particular, the heads 28 can be mounted in a stationary position with all of the relative movement necessary for generating the image being produced simply by moving the release media 30 past the print heads in the conveying direction 35. For example, as shown in FIG. 6, instead of using a single print head for each of the four basic colors, sets of multiple print heads 28, in this case three heads, can be provided for each of the four colors.

In the illustrated embodiment, each of the print heads 28 for a respective color are mounted on a mounting block 46 which is arranged in a fixed position over the release media 30. The three print heads 28 are each connected via a respective ink hose 42 to a common ink reservoir 48 which can be heated via a heating mechanism in order to help decrease the viscosity of the ink. The individual print heads 28 are mounted on the mounting block 46 in staggered relation so that as the release media 30 passes beneath the heads, the individual print heads produce swaths which are adjacent each other. In addition, the sets of print heads 28 for each of the four colors are supported on the stand 29 in aligned relation so that as the release media 30 passes in the conveying direction 35 beneath the four sets of stationary "triple" print heads, the print heads 28 discharge a controlled amount of their respective colored ink in precise overlapping relation so as to produce the desired color and image.

Figure 6:
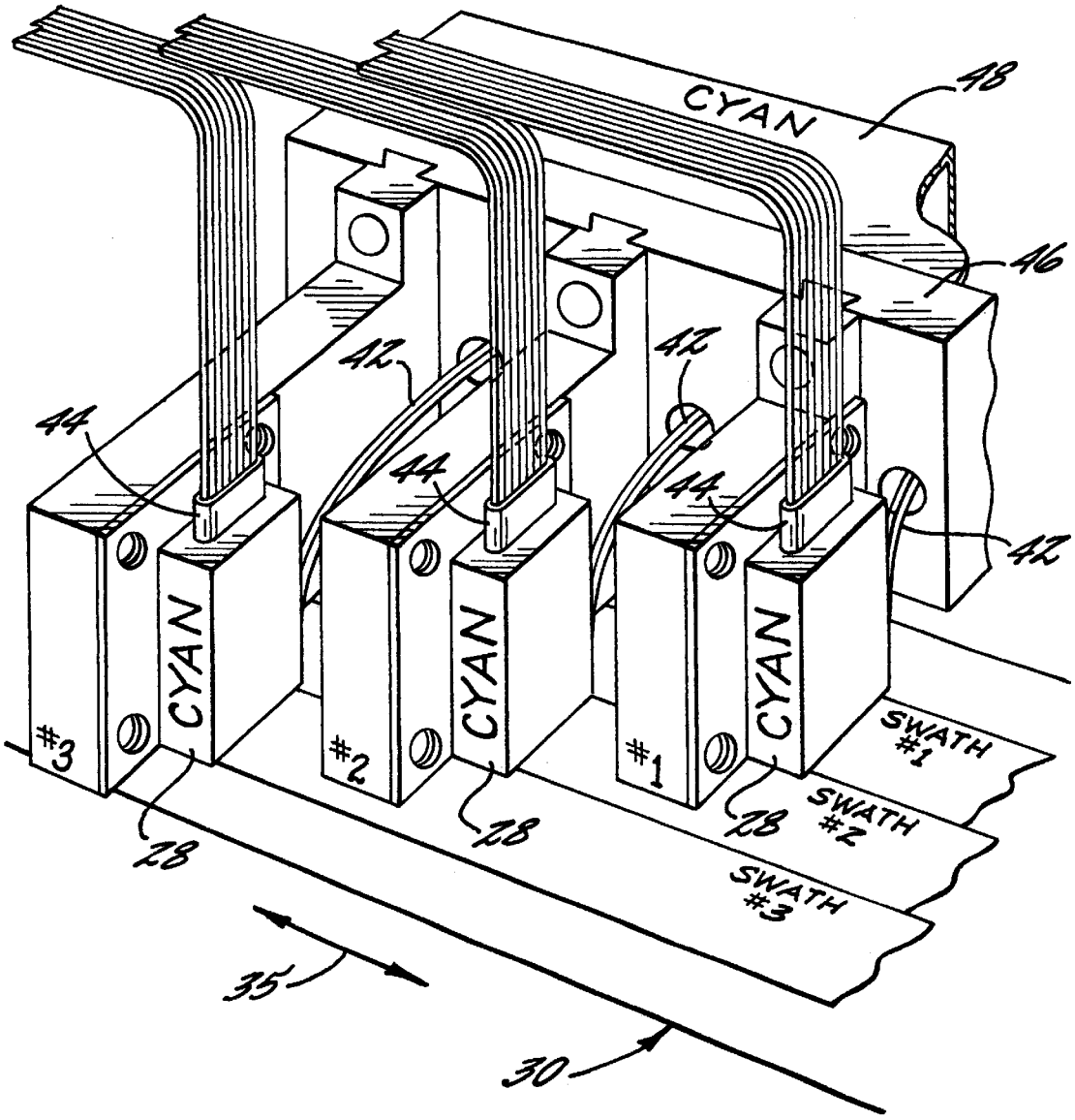
FIG. 6 is an enlarged perspective view of an alternative print head arrangement for the pad printing system.

As will be appreciated, since the reciprocating movement of the print heads 28 is eliminated in the embodiment of FIG. 6, the release media 30 can travel at a significantly higher rate which translates into a higher potential production capacity for the pad printing system 12. However, unlike the print head support arrangement shown in FIG. 4, which can be used to print images of any size, since the print heads 28 in the embodiment shown in FIG. 6 are fixed in relation to the release media 30, the size of the largest image which can be produced is limited by the number of print heads used. Of course, it will be appreciated by those skilled in the art that alternatively the carrier arrangement shown in FIG. 4 could be used with sets of multiple print heads in order to allow for greater flexibility in the size of the image. Such an arrangement would also provide increased production capacity by limiting the number of passes needed to print a given image as compared to using only single size print heads.

For transferring the print image from the release media 30 to the curved objects carried by the part conveyor 18, the pad printing system 12 of the present invention includes a pad transfer system 52. The pad transfer system 52 includes one or more transfer pads 54 made of a deformable material such as silicone rubber which when brought into contact with the release media 30 is capable of picking up an image produced by the digital printer 26 and, when brought into contact with a curved object, is capable of transferring the image to the object. Since the multicolor images are printed in complete form on the release media 30, the image does not need to be transferred to a precise location on the object to be printed. Accordingly, the precision controlled mechanisms required in existing multicolor pad printing systems are not needed with the present invention.

As shown in FIGS. 2 and 3, the pad transfer system 52 comprises, in this case, a plurality of transfer pads 54 which are supported on a rotatable pad carrier 56 arranged on the printing stand 29 between the release media conveyor 30 and the part conveyor 18. As will be appreciated, the use of multiple transfer pads 54 enables the printing system 12 to operate at an increased production capacity by allowing the digital printer 26 to operate continuously while the transfer operation occurs in parallel. As shown in FIG. 2, the pad carrier 56 is mounted on the print stand 29 not only for rotation but also on a vertical slide 58 and a horizontal slide 64 for linear movement along an axis perpendicular and an axis parallel to the conveying paths of the release media 30 and the part conveyor 18. Through these linear movements of the pad carrier 56, the image pick-up and transfer operation is executed via a stamping action. More particularly, in this case, the upward movement of the pad carrier 56 along the vertical slide 58 moves the deformable pad 54 in the pick-up position (the uppermost pad in the illustrated embodiment) into engagement with the release media conveyor 30 and thereby pick-up an image. Similarly, the downward movement of the pad carrier 56 along the vertical slide 58 moves the deformable pad 54 in the transfer position (the lowermost pad in the illustrated embodiment) into engagement with and an object carried in a printing position on the part conveyor and thereby transfer the image which it is carrying from an earlier executed pick-up movement. Suitable motors 57, 59 are provided to drive the rotation and linear movement of the pad carrier 56.

More specifically, in an exemplary operating sequence, the transfer pad 54 in the transfer position first stamps the image it is carrying onto the part 16 which is in the printing position on the part conveyor 18. Then, as the next part 16 is moved by the part conveyor 18 into the printing position, the pad 54 in the pick-up position moves to pick-up an image from the release media 30. The pad carrier 56 then rotates to sequentially advance the next pads into the pick-up and transfer positions. As this is occurring, the next colored image is brought into the pick-up position by the release media conveyor 30. The pick-up and transfer movements are then repeated.

In order to optimize production capacity and ensure that the image is not disturbed during the pick-up and transfer operations, the speed of the pad carrier 56 must be synchronized to the release media 30 during pick-up and to the part conveyor 18 during image transfer. More specifically, since the digital printer should operate continuously to ensure optimal production capacity, the pad carrier 56 must move horizontally along the slide 64 at the same speed as the release media during the pick-up operation so as to prevent distortion of the 30 image during pick-up. Likewise, when the image is being transferred to the part the pad carrier 56 must be moving horizontally at the same speed as the part conveyor 18 during the transfer operation. Of course, it will be understood that the release media 30 and part conveyor 18 could remain stationary during the respective pick-up and transfer operations.

To facilitate the transfer operation, the drive motors 57, 59 for the rotary and linear movement of the pad carrier 56 are synchronized through the common control system 45 (as shown in FIG. 2) with the control for the digital printer 26 and with the drive motors 32, 19 of the release media and part conveyors. As will be understood by those skilled in the art, this control system can be integrated with the programmable controller for the digital printer 26 or comprise a separate control system which is in communication with the digital printer 26. Alternatively, the synchronization could be accomplished mechanically.

In order to enable the pad printing system 12 to be adjusted vertically for parts having different heights, an adjustment crank 60 is provided on the top of the print stand 29. By turning the adjustment crank 60, the position of the digital printer 26, release media conveyor 30 and pad carrier 56 can be adjusted relative to the part conveyor 18. Additionally, a heating mechanism (not shown) can be provided to the heat the release media 30 in order to enhance the transfer of the images from the release media to the transfer pads 54. Depending on the pressure which is applied to the release media 30 during the pick-up operation as well as the construction of the release media conveyor, it may also be necessary to provide a support surface underneath the release media in the area where the pick-up operation occurs. To ensure that friction between the release media 30 and such a support surface does not cause fluctuations in the speed at which the release media is traveling, which would adversely impact print quality, the underside of the release media conveyor can be coated with a low friction material such as Teflon®.

It has been found that the quality of the image produced by the pad printing system 12 of the present invention is decreased when the objects to be printed are not white in color. Accordingly, the present system can be adapted to first print a white ink layer on a part and then to apply the color image on the part in overlapping relation to the white ink layer. As shown in FIG. 3, in the illustrated embodiment, a standard cliche plate arrangement 62 is provided adjacent the pad carrier 56 from which a white ink layer can picked-up and transferred to an object carried by the part conveyor 18. When a white layer is needed because of the color of the parts to be printed, the transfer pads 54 alternate between executing a horizontal movement to contact and pick-up a white layer from the cliche plate 62 and executing a vertical movement to pick-up a color image from the release media conveyor 30. Accordingly, only every other transfer pad 54 (e.g., the pads designated with the number 2 in FIG. 3) on the pad carrier 56 is used to pick-up a color image from the release media 30, while the other pads (e.g., the pads designated with the number 1 in FIG. 3) pick-up a white ink layer. Alternatively, the white ink layer could be printed by the digital printer 26 or by a separate digital printer.

In operation, when the colored part is advanced into the printing position by the part conveyor 18, a first transfer pad 54 having a white layer from the cliche plate 62 is rotated into the transfer position and stamped onto the part. Next, a second transfer pad 54 carrying a color image from the release media 30 is rotated into the transfer position and stamped onto the part in overlying relation to the white ink layer. Once both the white layer and the color image have been applied to the part, the part conveyor 18 can advance the next part into the printing position. A pad cleaning device 66 can be arranged opposite the cliche plate 62 as shown in FIG. 3 in order to clean any residual ink from the pads 54 before they are rotated back into the pick-up position. The individual pads can be brought into engagement with the pad cleaner 66 through a horizontal movement of the pad carrier 56 or by arranging the pad cleaning device so that the pads 54 they engage the cleaner as they rotate past and back towards the pick-up position. As will be appreciated, having to print the white layer on the parts prior to printing the color image decreases by half the production capacity of the printing system. In order to avoid this reduction in production capacity, the white layer alternatively could be applied to the parts by a separate printing station arranged upstream from the digital pad printing system 12.

Figure 7:
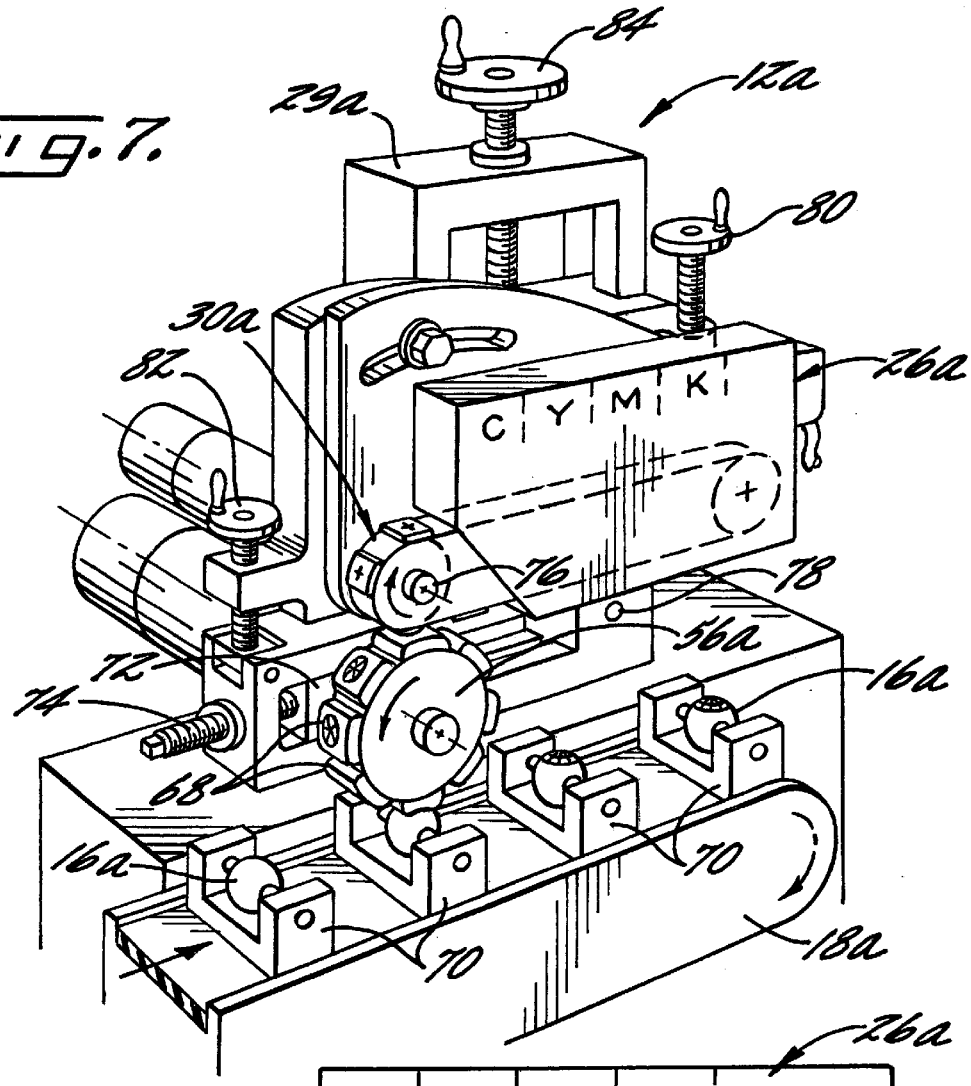
FIG. 7 is perspective view of an alternative embodiment of the pad printing system of the present invention which picks up and transfers images through a roll-off action.
Figure 8:
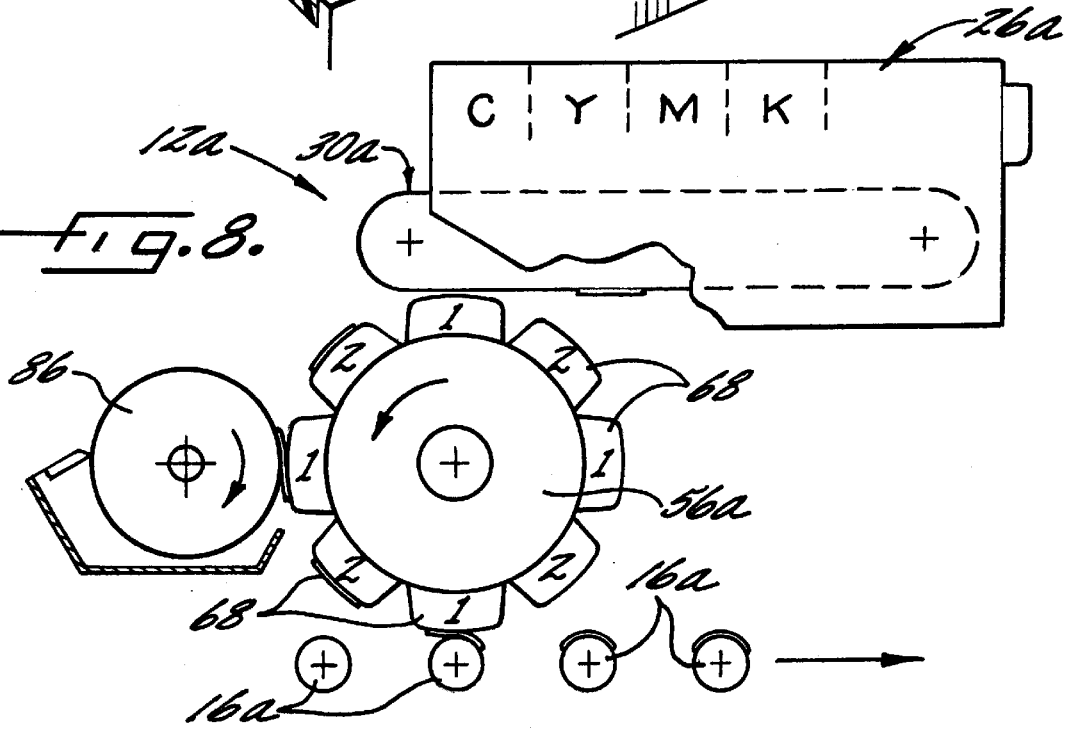
FIG. 8 is a schematic partial side elevation view of the pad printing system of FIG. 7.

In an alternative embodiment, the pad transfer system can be configured to pick-up and transfer images by a roll-off action as opposed to stamping. With the alternative embodiment shown in FIGS. 7 and 8 items similar to those described above have been given similar reference numerals with the distinguishing suffix "a" added. As shown in FIGS. 7 and 8, with this alternative embodiment, the rotatable pad carrier 56*a* is equipped with one or more "roll-off" type transfer pads 68. The pad carrier 56*a* is arranged so that the roll-off pads 68 are brought into engagement with the release media 30*a* and parts 16*a* by the rotation of the pad carrier. The roll-off transfer pads 68, in turn, are configured to pick-up and transfer the images through the rolling action which results when the pads engage the release media 30*a* and parts 16*a*. Accordingly, the need for reciprocating the pad carrier in a linear direction is eliminated. More specifically, as shown in FIG. 8, the image is picked up from the release media 30*a* as the roll-off pad 68 in the pick-up position (again in the illustrated embodiment the uppermost pad) contacts and rolls over the image on the release media 30*a* as the pad is rotated by the carrier 56*a* through the pick-up position. Likewise, the image is transferred to the part as the roll-off pad 68 in the transfer position (the lowermost pad in the illustrated embodiment) contacts and rolls over the surface of the part 16*a* as the pad rotates through the transfer position. In order to ensure that the image can be properly rolled onto the part 16*a*, the part conveyor 18*a* includes part carrying fixtures 70 which allow the surface of the part to be rolled along the roll-off pad 68, as the pad contacts the part and rotates through the transfer position. As with the embodiment disclosed in FIGS. 1–6, the rotation of the pad carrier 56*a* must be synchronized with the digital printer 26*a* and the movement of the release media and part conveyors 30*a*, 18*a* to ensure optimal print quality and production output.

In order to enable adjustment of the pick-up point as well as the pick-up pressure, the print stand 29*a* is equipped with various adjustment mechanisms. As will be appreciated by those skilled in the art, the quality of the image which is transferred to the curved part can be adjusted by varying where the image is picked up from the release media 30*a* by the roll-off transfer pads 68. Accordingly, the pad carrier 56*a* is mounted on slide block 72 which is adjustable in a direction parallel to the conveying direction of the release media 30*a* via an adjustment screw 74, as shown in FIG. 7. Additionally, the digital printer 26*a* and release media conveyor 30*a* are mounted on the print stand 29*a* so that they are pivotable about first and second pivot points 76, 78. To further adjust the pick-up position, a pick-up adjustment crank 80 is provided which pivots the printer 26*a* and release media conveyor 30*a* about the first pivot point 76. To enable the pick-up pressure applied by the roll-off transfer pads 68 to be adjusted, a pick-up pressure regulation crank 82 is provided which can be used to pivot the digital printer 26*a* and release media conveyor 30*a* about the second pivot point 78 and thereby increase or decrease the pick-up pressure. A vertical adjustment 84 is also provided to allow for adjustment of the printing stand 29*a* based on the height of the parts to be printed.

As with the embodiment shown in FIGS. 1–6, to allow high quality color images to be printed on objects that are not white in color, the pad printing system 12*a* can be adapted to first print a white ink layer on the part and then print the color image over the white ink layer. As shown in FIG. 8, in the illustrated embodiment, this is accomplished by arranging a rotary printer 86 adjacent the pad carrier 56*a*. As with the embodiment shown in FIGS. 1–6, when the white ink layer is necessary, color images are only picked-up by every other roll-off pad (e.g., the pads designated with the number 2 in FIG. 8) which rotates through the pick-up position. The other roll-off pads (e.g., the pads designated with the number 1 in FIG. 8) receive a white ink layer from the rotary printer 86. However, since the roll-off pads 68 which are intended to carry a white layer still contact the release media 30*a*, the rotation of the pad carrier 56*a* must be synchronized so that the pads which are to receive a white layer contact the release media in the space between consecutive color images. Likewise, the rotation of the pad carrier 56*a* must be synchronized with the rotary white layer printer 86 so that the rotary printer does not disturb the roll-off pads 68 which are carrying a color image.

In operation, when a part 16*a* is brought into the print position by the part conveyor 18*a*, a first roll-off pad 68 is rotated into and through the transfer position to roll a white layer onto the part and then a second roll-off pad 68 is rotated into and through the transfer position so as to roll a color image over the white layer. Once both the white layer and the color image have been sequentially printed on the part, the part conveyor 18*a* advances the next part into the printing position.

From the foregoing, it can be seen that a multicolor pad printing system is provided which allows high quality color images to be printed on curved or flat objects. Since the multicolor image is printed in complete form on the release media, there is no need to place the image in a precise location on the object to be printed. Accordingly, the expensive precision controlled mechanisms for moving and guiding the printing pad and the object to be printed which are necessary on existing multicolor pad printing systems can be eliminated. The elimination of the these precision controlled systems as well as the four separate color stations used in existing systems allows the present invention to be operated much more efficiently and economically. Additionally, the digital printer which is used can be easily programmed to produce different images, thus enabling the printing system of the present invention to be quickly and easily set-up to produce any type of custom multicolor image.

What is claimed is:

1. A pad printing system for applying multicolor images to an object comprising:

a substantially flat release substrate having an ink receiving surface, a digital printer having a plurality of print heads arranged to discharge ink in a plurality of colors onto the ink receiving surface of the release substrate, the print heads and release substrate being movable relative to each other such that the discharge of ink from the print heads prints a multicolor ink image on the ink receiving surface of the release substrate, and at least one deformable ink transfer pad movable into pressure contact with the release substrate for receiving a multicolor ink image therefrom and being movable into pressure contact with an object to be printed for transferring a multicolor ink image from the transfer pad to the object.

2. The pad printing system according to claim 1 wherein the release substrate is configured as an endless conveyor which cycles past the plurality of print heads in a conveying direction.

3. The pad printing system according to claim 2 wherein the release substrate conveyor is configured such that the multicolor image is printed on the release substrate at a printing location on the release substrate conveyor and conveyed to a transfer location where the transfer pad contacts the release substrate and receives the image therefrom.

4. The pad printing system according to claim 2 wherein the print heads are supported on a carrier for reciprocal movement across the release substrate in a direction substantially perpendicular to the conveying direction of the release substrate conveyor and the print heads print the multicolor image on the release substrate through one or more passes across the release substrate.

5. The pad printing system according to claim 4 wherein each of the print heads discharges ink in a respective one of four basic colors.

6. The pad printing system according to claim 2 wherein the print heads are supported in a stationary position relative to the release substrate and the print heads print the multicolor ink image on the release substrate as the release substrate is conveyed past the print heads in the conveying direction.

7. The pad printing system according to claim 6 wherein the digital printer includes a plurality of sets of multiple print heads with each set of print heads being configured to discharge ink in a respective one of four basic colors.

8. The pad printing system according to claim 1 wherein the transfer pad moves into contact with the release substrate and the object to be printed with respective stamping movements.

9. The pad printing system according to claim 1 wherein the transfer pad moves into contact with the release substrate and the object to be printed with respective roll-over movements.

10. The pad printing system according to claim 1 wherein said at least one deformable ink transfer pad comprises a plurality of transfer pads.

11. The pad printing system according to claim 10 wherein the plurality of transfer pads are arranged on a carrier which is movable so as to sequentially advance the transfer pads through a pick-up position where the transfer pads are moved into contact with the release substrate to receive the multicolor ink image therefrom and a transfer position where the transfer pads are moved into contact with the object to be printed to transfer the multicolor ink image to the object.

12. The pad printing system according to claim 11 wherein the carrier moves each transfer pad into contact with the release substrate when the respective transfer pad reaches the pick-up position with a stamping movement and moves each transfer pad into contact with the object to be printed when the respective transfer pad reaches the transfer position with a stamping movement.

13. The pad printing system according to claim 12 wherein the pad carrier is rotatably supported such that the transfer pads move between the pick-up and transfer positions through rotation of the pad carrier.

14. The pad printing system according to claim 13 wherein the pad carrier is further supported for reciprocal movement in a direction perpendicular to the release substrate for moving the transfer pad in the pick-up position into pressure contact with the release substrate and the transfer pad in the transfer position into pressure contact with the object to be printed.

15. The pad printing system according to claim 11 wherein the carrier moves each transfer pad into contact with the release substrate when the respective transfer pad reaches the pick-up position with a roll-off movement and moves each transfer pad into contact with the object to be printed when the respective transfer pad reaches the transfer position with a roll-off movement.

16. The pad printing system according to claim 15 wherein the pad carrier is rotatably supported such that the transfer pads move between the pick-up and transfer positions and are brought into pressure contact with the release substrate and the object to be printed through rotation of the pad carrier.

17. The pad printing system according to claim 1 further including a part conveyor which sequentially advances curved objects to be printed into a printing position where the objects are contacted by the deformable pad for transferring the multicolor ink image from the transfer pad to the curved object.

18. The pad printing system according to claim 1 further including a white ink printer having a white ink receiving surface wherein the deformable pad is movable into pressure contact with the white ink receiving surface for receiving a layer of white ink therefrom.

19. The pad printing system according to claim 18 wherein the white ink receiving surface is substantially flat and the transfer pad moves into contact with the white ink receiving surface through a stamping movement.

20. The pad printing system according to claim 18 wherein the white ink receiving surface is a rotary cylinder and the transfer pad contacts the white ink receiving surface by rolling over the white ink receiving surface.

21. The pad printing system according to claim 18 wherein said at least one deformable ink transfer pad comprises a plurality of transfer pads arranged on a carrier which is movable relative to the release substrate, white ink receiving surface and object to be printed.

22. The pad printing system according to claim 21 wherein the pad carrier is movable such that a first transfer pad receives a layer of white ink from the white ink receiving surface and a second transfer pad receives a multicolor image from the release substrate and being movable such that the first transfer pad transfers the white ink layer to the object to be printed and transfers the image to the object in overlying relation to the white ink layer.

23. A pad printing system for applying multicolor images to an object comprising:

a digital printer having a plurality of print heads for discharging ink in a plurality of colors, a substantially flat endless release conveyor having an ink receiving surface, the release conveyor being arranged to cycle past the print heads and thereby receive a multicolor ink image on the ink receiving surface and carry said multicolor image to a transfer position before cycling back past the print heads, at least one deformable ink transfer pad movable into pressure contact with the release conveyor at the transfer position for receiving a multicolor ink image therefrom and being movable into pressure contact with an object to be printed for transferring a multicolor ink image from the transfer pad to the object.

24. The pad printing system according to claim 23 further including a control system for synchronizing movement of the release conveyor and the transfer pad such that the movement of the transfer pad into pressure contact with the release conveyor and the discharge of ink from the print heads can occur simultaneously.

25. The pad printing system according to claim 23 wherein the release conveyor moves past the print heads in a conveying direction and the print heads are supported on a carrier for reciprocal movement across the release conveyor in a direction substantially perpendicular to the conveying direction.

26. The pad printing system according to claim 25 wherein each of the print heads discharges ink in a respective one of four basic colors.

27. The pad printing system according to claim 23 wherein the release conveyor moves past the print heads in a conveying direction and the print heads are supported in a stationary position relative to the release substrate and the print heads print the multicolor ink image on the release conveyor as the release conveyor cycles past the print heads in the conveying direction.

28. The pad printing system according to claim 23 wherein said at least one deformable ink transfer pad comprises a plurality of transfer pads.

29. The pad printing system according to claim 28 wherein the plurality of transfer pads are arranged on a carrier which is movable so as to sequentially advance the transfer pads through a pick-up position where the transfer pads are moved into contact with the release conveyor to receive the multicolor ink image therefrom and a transfer position where the transfer pads are moved into contact with the object to be printed to transfer the multicolor ink image to the object.

30. The pad printing system according to claim 29 wherein the pad carrier is rotatably supported such that the transfer pads move between the pick-up and transfer positions through rotation of the pad carrier.

31. The pad printing system according to claim 23 further including a white ink printer having a white ink receiving surface wherein the deformable pad is movable into pressure contact with the white ink receiving surface for receiving a layer of white ink therefrom.

32. The pad printing system according to claim 31 wherein said at least one deformable ink transfer pad comprises a plurality of transfer pads arranged on a carrier which is movable relative to the release conveyor, white ink receiving surface and object to be printed.

33. The pad printing system according to claim 32 wherein the pad carrier is movable such that a first transfer pad receives a layer of white ink from the white ink receiving surface and a second transfer pad receives the multicolor ink image from the release conveyor and being movable such that the first transfer pad transfers the white ink layer to the object to be printed and transfers the image to the object in overlying relation to the white ink layer.

* * * * *